United States Patent [19]

Pourtau et al.

[11] Patent Number: 4,829,976

[45] Date of Patent: May 16, 1989

[54] TOOL FOR CUTTING TILES IN EARTHENWARE OR SIMILAR MATERIALS

[75] Inventors: Thierry Pourtau, Croissy Sur Seine; Abel Thiriet, Dole, both of France

[73] Assignee: Tomecanic, Aubergenville, France

[21] Appl. No.: 65,412

[22] Filed: Jun. 22, 1987

[30] Foreign Application Priority Data

Jun. 27, 1986 [FR] France ..... 86 09394

[51] Int. Cl.[4] ..... B28D 5/04

[52] U.S. Cl. ..... 125/36; 7/158; 16/114 R; 30/125; 30/164.9; 81/177.1

[58] Field of Search ..... 125/36, 39, 42, 43; 30/164.9, 164.95, 125, 123; 83/879; 269/6, 88; 7/158, 167, 170; 81/177.1; 16/114 R

[56] References Cited

U.S. PATENT DOCUMENTS

| | | | |
|---|---|---|---|
| 91,312 | 6/1969 | Dickinson | 125/39 |
| 305,449 | 9/1884 | Hall | 125/36 X |
| 1,377,829 | 5/1921 | Hager | 81/177.1 X |
| 1,710,113 | 4/1929 | Rothermel | 7/158 X |
| 2,564,812 | 8/1951 | McGuire | 81/177.1 X |
| 2,674,286 | 4/1954 | Carson | 81/177.1 X |
| 2,705,336 | 4/1955 | Wilson | 16/114 R |
| 2,951,482 | 9/1960 | Sullivan | 16/114 R X |
| 3,034,550 | 5/1962 | Dahl | 7/167 X |
| 3,619,009 | 11/1971 | O'Leary | 16/114 R X |
| 4,285,096 | 8/1981 | Swaim | 16/114 R |
| 4,314,383 | 2/1982 | Epstein | 7/170 |

FOREIGN PATENT DOCUMENTS

| | | | |
|---|---|---|---|
| 641184 | 1/1937 | Fed. Rep. of Germany | 125/39 |
| 740534 | 1/1933 | France | 125/39 |
| 0214962 | 5/1941 | Switzerland | 125/39 |
| 1270599 | 4/1972 | United Kingdom | 125/36 |

*Primary Examiner*—Frederick R. Schmidt
*Assistant Examiner*—Shirish Desai
*Attorney, Agent, or Firm*—Bell, Seltzer, Park & Gibson

[57] ABSTRACT

The invention relates to a cutting tool constituted by an elongated body having a first end and a second end, and being provided at each of these ends with means such as a screw thread for removably fixing a holding member or handle, and at its first end with a first cutting point. The second end is equipped with a second cutting point. The invention is applied to the production of a tool for cutting earthenware tiles.

2 Claims, 3 Drawing Sheets

TOOL FOR CUTTING TILES IN EARTHENWARE OR SIMILAR MATERIALS

FIELD OF THE INVENTION

The invention relates to a tool for cutting tiles in earthenware or similar materials.

BACKGROUND OF THE INVENTION

A tool for cutting slabs of earthenware or similar material, such as earthenware tiles, is already known and is constituted by an elongated body with a first end and a second end, which body is equipped at each of these ends with means such as a screw thread for removably fixing a holding member or handle, and at its first end, with a cutting point.

The handle has two functions: the first one is to enable the user, when it is fitted on the end opposite to the cutting point, to hold the tool firmly and with force, without hurting his hand; the second one is, when the user is not using the tool but transports it, to protect the point from any damages which could be caused thereto, and to protect the environment (i.e. clothes, tool bags, and other tools) from any damages that could be caused by said point, provided of course that said handle has been fixed on the first end and covers the said point. It should be noted that, with this known disposition, the tool is provided with only one cutting point, situated on the first end of said body, the second end being generally constituted by a straight cross-section of the tool body.

According to the prior art, the one and only handle which is provided, can have different shapes, and for example can be constituted either by a sort of hood of rounded shapes, with the sole functions of making the tool easy to hold, and of protecting the cutting point, depending on the effective use of the tool, or by a gripping nose which enables an already cut tile to be subjected to a force causing the splitting of the tile in two parts on either side of the cutting line. It should be noted that in both cases, the handle has the function of protecting the point, bearing in mind that the other end has no need to be protected since it is not pointed and therefore is not dangerous.

SUMMARY OF THE INVENTION

It is the object of the invention to propose a tool of the aforesaid known type, and to arrange for the second end to be also equipped with a cutting point.

The following advantageous dispositions are also preferably adopted:

in manner known per se, the handle is shaped into a gripping nose, for gripping the edge of a tile in earthenware or similar material;

the tool comprises two separate removable handles, with each one of which the tool can be gripped and the point situated on the fixing end of the tool can be protected, one of said two handles being shaped as a gripping nose for holding the edge of a tile in earthenware or similar material.

At this stage, it seems well-advised to make the following observations:

although the idea of providing a second cutting point is a simple one, it is nevertheless novel and its non-obviousness is unquestionable for the following reasons;

the fact of providing a second cutting point doubles the working life of the tool, but, and this is not obvious, without doubling its price: indeed, the cutting points are often parts that are added to the body of the tool, in tungsten carbide for example, which is inexpensive compared to the rest of the tool, and their assembling method is also simple and inexpensive, so that a second cutting point ca only increase the cost price by no more than 10% while offering the advantage of doubling the working life of the tool;

the fact of providing a second cutting point is not obvious either from the prior art since, with one handle and two cutting points, the tool will permanently have one cutting point which is apparent, unprotected and dangerous for the environment; starting with a tool comprising only one cutting point and one handle, anyone skilled in the art ended by eliminating the known advantage of the protection of the single cutting point by the handle, in the inactive configuration of the tool;

unless one of the preferred dispositions according to the invention is adopted, namely that two handles are provided in order to protect the two cutting points of the tool, when said tool is not in use; thereagain, the fact of providing a second handle is nowhere suggested in the prior art where the tool is described as having only one cutting point and one handle; what in the known disposition, could have been the advantage of providing a second handle, to protect what?;

the invention therefore essentially resides in the fact of having, for the first time, expressed a new principle of construction, a simple one may be, but one which presents great advantages, i.e. to be able to put on sale tools with two cutting points for practically the same price as tools with only one cutting point, and if this new structure could have been obvious, it would necessarily have been adopted long ago; the fact that it was not, before the present invention, is therefore enough to prove its lack of obviousness and consequently to prove the inventive step involved in the present invention;

the present invention therefore relates to cutting tools with two cutting points, the designation "cutting point" designating of course the sharp points proper, the cutting prisms, the cutting plates of tools used for cutting ceramics, tiles, earthenwares and similar materials.

BRIEF DESCRIPTION OF THE DRAWINGS

The invention will be more readily understood on reading the following description with reference to the accompanying drawings, in which:

FIG. 3 is a view of a second embodiment of the tool according to the invention in its active configuration.

DETAILED DESCRIPTION OF THE INVENTION

Figure 1:
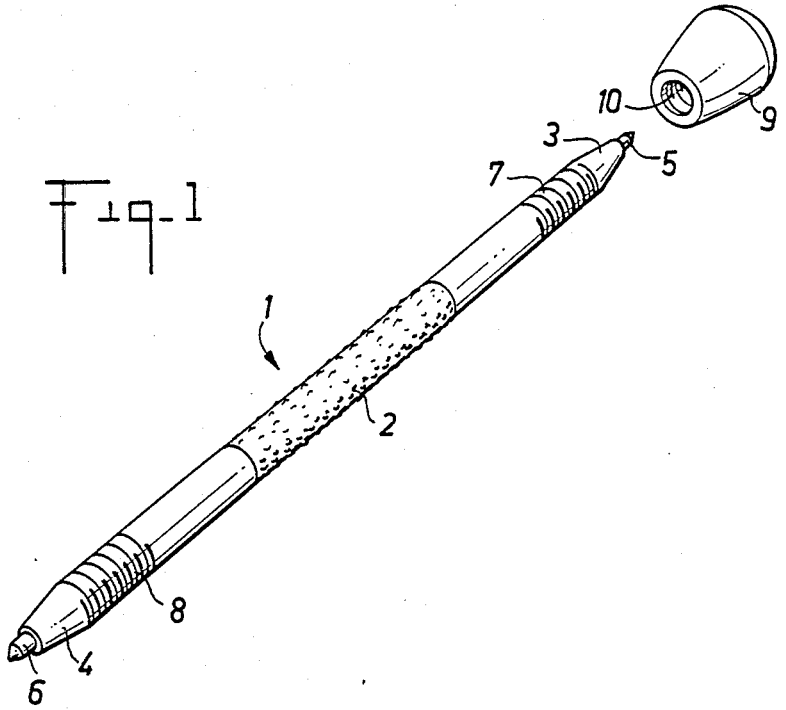
FIG. 1 is an exploded view of a first embodiment of the tool according to the invention.
Figure 2:
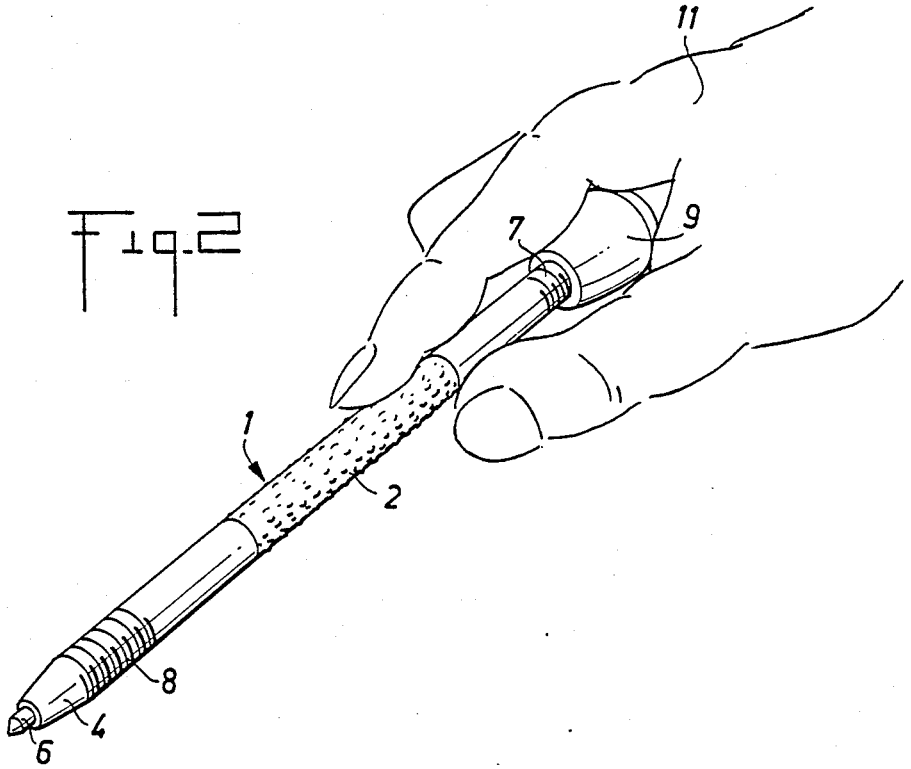
FIG. 2 is a view of the tool shown in FIG. 1, in an active cutting configuration.
Figure 1:
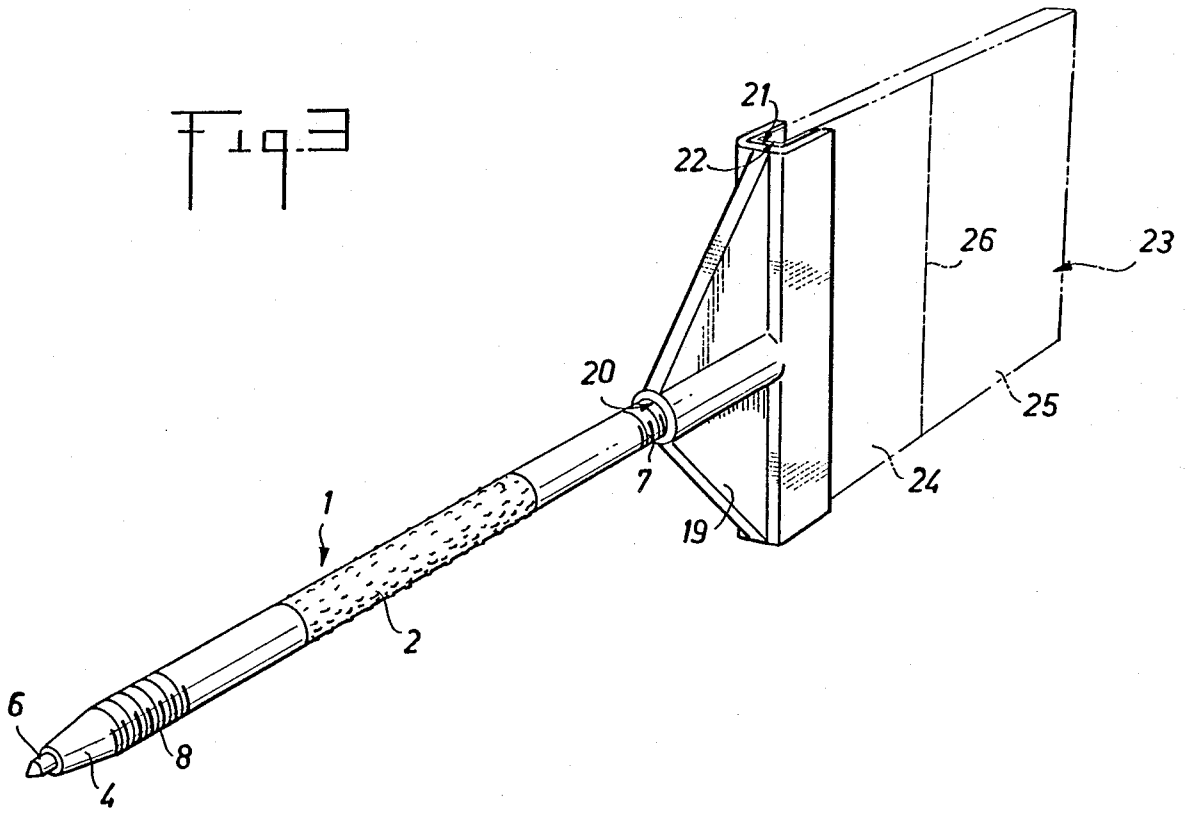

The tool according to FIGS. 1 and 2 is constituted by:

a body 1, made of steel, of elongated, generally cylindrical shape, of which the middle part is provided with non-slip serrations 2 and comprising a first end 3 and a second end 4;

a first cutting point 5, separate from the first end 3, and set thereon, produced in tungsten carbide;

a second cutting point 6, separate from the second end 4 and set thereon, produced in tungsten carbide;

first 7 and second 8 screw threads, provided on the cylindrical parts of the body 1, close to said first and second ends, respectively;

one handle 9, provided with a tapped hole 10, adapted to cooperate indifferently with either one of threads 7 and 8, said handle having general rounded shapes.

The cutting points could, as a variant, be in one-piece with the body 1, although it is often preferred to produce them separate from the body 1 and to fit them subsequently on said body 1.

Also, the threads 7, 8 and the tapping 10, adequate for fixing the handle 9 to either one of ends 3 and 4 of the body 1, could, as a variant, be replaced by any other means for removably fitting said handle (elastic interlocking, keying, or the like).

FIG. 2 shows the tool in its configuration of use in which the second cutting point 6 is used, the hand 11 of the user having a good hold on the tool by the protecting handle 9 which prevents the user from injuring his hand with the first cutting point covered by said handle.

The embodiment shown in FIG. 3 is the same as that shown in FIGS. 1 and 2, and comprises two cutting points, with the exception that the shape of the handle 19 is different. Said handle is screwed on the thread 7 of the first end of body 1 and protects the first cutting point. At the opposite of its tapped hole 20, said handle is provided with a groove 21, which extends substantially perpendicularly to the axis of body 1 and which constitutes a sort of gripping nose, gripping the edge 22 of an earthenware tile 23.

Said tile, being cut previously into two parts 24 and 25 separated by a cutting line 26, by the second cutting point 6, the edge 22 of part 24 of the tile is gripped in groove 21, which makes it possible, by a bending movement about cutting line 26 to separate the two parts 24, 25 of the tile.

Obviously, the cutting operation with the second cutting point 6 and the handle 19 is the same as that performed with the tool according to FIGS. 1 and 2.

Figure 4:
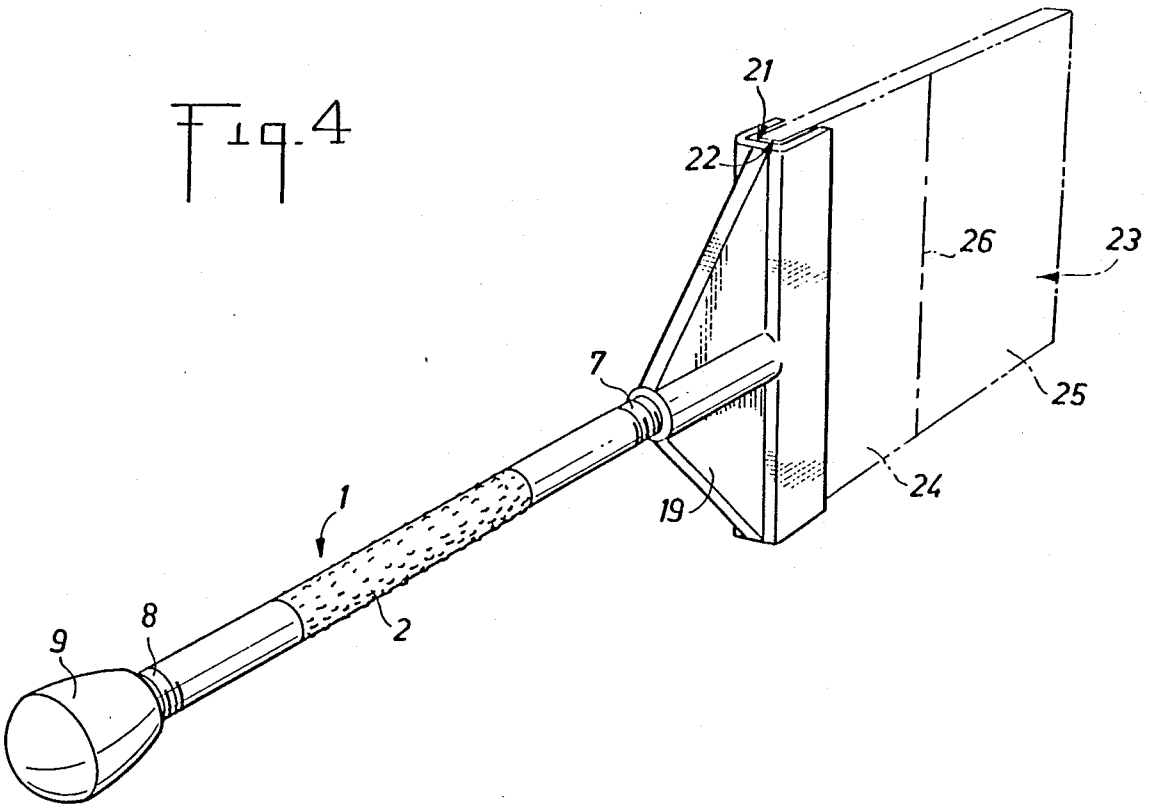
FIG. 4 is a view of a third embodiment of the tool according to the invention, showing the two points protected (inactive configuration).

The tool according to FIG. 4 is identical to that shown in FIG. 3, except for the addition of handle 9 (the handle of FIGS. 1 and 2), which, in the illustrated configuration, is screwed on the thread 8 of the second end of body 1 and which covers and conceals the second cutting point.

Thus, with the tool of FIG. 4:

when one of the cutting points is uncovered, the corresponding handle 9 or 19 being removed, the user can have a good hold on the tool and on the other handle, and cut the earthenware tile with the uncovered cutting point;

with the two handles on the tool, in the configuration of protection of the two cutting points, the user can either split the two parts of the earthenware tile, without any danger of hurting himself with the cutting point opposite to the groove 21, due to the presence of handle 9, or if only transporting the tool and not using it, he can place it anywhere without any fear of the tool damaging the environment, or of the tool cutting points being damaged, since they are both protected by the removable handles 9 and 19.

Understandably, in every one of the three illustrated embodiments, when one of the cutting points is worn out, the user immediately has a new cutting point available. All he needs to do, with the embodiment according to FIGS. 1 and 2, is to screw the handle, not on the thread 7 but on the thread 8, thereby concealing the second cutting point 6, and uncovering the first cutting point 5. In the embodiment according to FIG. 3, the user only needs to move the handle 19 and screw it on the thread 8. The same possibility of course exists with the embodiment shown in FIG. 4.

The invention is in no way limited to the description given herein above and on the contrary covers any modifications that can be brought thereto without departing from its scope.

What is claimed is:

1. In a tool for cutting slabs of earthenware or similar materials, such as earthenware tiles, the combination of an elongated body member including first and second opposite end portions, first and second identical cutting tool points fixed in and extending outwardly from said corresponding first and second end portions of said body member, first and second external screw threads formed on said body member and adjacent said corresponding first and second end portions of said body member, and first and second gripping protective handle members each including internal screw threads engaged with the corresponding first and second screw threads to power and form a protective cover for the corresponding first and second cutting tool points, said first and second handle members being selectively removable from either of said first and second external screw threads on said body member so that the other of said handle members can form a protective cover for the corresponding cutting tool point while leaving the other cutting tool point uncovered and available for use and wherein one of said gripping protective handle members comprises a gripping nose including an outer free end with a perpendicular groove therein, and wherein said perpendicular groove in the outer free end portions of one of said gripping protective handle members is adapted to grip the edge of an earthenware tile while said one gripping protective handle member serves to cover one of said cutting tool points.

2. A cutting tool according to claim 1 wherein said other gripping protective handle member includes a generally rounded exterior shape, and internal screw threads adapted to be engaged with said second external screw threads on the other end portion of said body member so that both of said first and second cutting tool points on opposite ends of said body member can be covered and protected by said first and second gripping protective handle members.

* * * * *